US008701355B2

(12) United States Patent
Sexton

(10) Patent No.: US 8,701,355 B2
(45) Date of Patent: Apr. 22, 2014

(54) COLLAPSIBLE ROOF CURB

(75) Inventor: Michael Paul Sexton, Indianapolis, IN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 0 days.

(21) Appl. No.: 13/398,891

(22) Filed: Feb. 17, 2012

(65) Prior Publication Data

US 2012/0210654 A1 Aug. 23, 2012

Related U.S. Application Data

(60) Provisional application No. 61/444,326, filed on Feb. 18, 2011.

(51) Int. Cl.
*E04D 1/36* (2006.01)
*E04D 13/147* (2006.01)

(52) U.S. Cl.
CPC ..... *E04D 13/1475* (2013.01)
USPC ..... 52/58; 52/69; 52/71

(58) Field of Classification Search
CPC .. E04D 13/14; E04D 13/1475; E04D 13/1415
USPC ..... 52/58, 69, 71, 72, 198; 98/86
See application file for complete search history.

(56) References Cited

U.S. PATENT DOCUMENTS

| | | | | | |
|---|---|---|---|---|---|
| 1,021,782 | A * | 4/1912 | Klein | 454/199 |
| 3,216,161 | A * | 11/1965 | Forsman | 52/200 |
| 3,728,956 | A * | 4/1973 | Field | 454/357 |
| 3,742,659 | A * | 7/1973 | Drew | 52/19 |
| 4,917,345 | A * | 4/1990 | Czech | 248/678 |
| 5,791,092 | A * | 8/1998 | Strieter | 52/27 |
| 2004/0142654 | A1 * | 7/2004 | Stammer et al. | 454/357 |
| 2004/0245418 | A1 * | 12/2004 | Capozzi et al. | 248/237 |
| 2005/0178078 | A1 * | 8/2005 | Valentz et al. | 52/200 |
| 2011/0017967 | A1 * | 1/2011 | Whiting | 256/59 |

OTHER PUBLICATIONS

Co-pending provisional U.S. Appl. No. 61/600,151 to Hasan et al. filed Feb. 17, 2012 entitled "Modular Roof Curb"; 16 pages.

* cited by examiner

*Primary Examiner* — Basil Katcheves
(74) *Attorney, Agent, or Firm* — Jason A. Houser; Arthur M. Reginelli

(57) ABSTRACT

A collapsible roof curb includes a base portion having opposed end walls and opposed side walls extending between the end walls, and an upper portion having opposed upper end walls and opposed upper side walls. The roof curb also includes a hinge connecting each of the end walls of the base portion to the end walls of the upper portion and the side walls of the base portion to the side walls of the upper portion, the hinges being adapted to allow the end walls and side walls of the upper portion to pivot from a collapsed position to an extended position.

2 Claims, 3 Drawing Sheets

COLLAPSIBLE ROOF CURB

This application claims priority from U.S. Provisional Patent Application Ser. No. 61/444,326 filed on Feb. 18, 2011, which is incorporated herein by reference in its entirety.

FIELD OF THE INVENTION

One or more embodiments of the present invention relate to a collapsible or foldable roof curb. In one or more embodiments, the collapsible roof curb may include a single or double walled welded metal base portion and upper wall metal portions that are hingedly or foldably connected to the base portion.

BACKGROUND OF THE INVENTION

Roof curbs are used in the roofing industry as a mounting base for many rooftop systems, rooftop units (RTUs) or appurtenances. For example, skylights and HVAC systems may be mounted to a roof curb that is positioned above a roofing surface and structurally mounted to the roofing deck or substrate. Known roof curbs include welded metal curbs that are rectangular in shape, having opposing end walls, and opposing side walls extending between the end walls. A mounting flange may extend outwardly from a bottom edge of the end walls and side walls to facilitate attachment of the curb to the roofing deck or substrate. Additionally, a nailer may be provided at an upper edge of the roof curb to facilitate attachment of the rooftop system, e.g. skylight or HVAC system and roof waterproofing layers or membranes. The roof curb is installed over and surrounding an opening in the roof deck or substrate that provides access to the interior of the building.

Conventional roof curbs may be field fabricated and installed on rooftops by experienced metal workers and welders, but this process is very time consuming, inefficient and potentially hazardous. For this reason, roof curbs are often pre-fabricated. Pre-manufactured roof curbs must be shipped to job sites for installation, and often must be stored after being manufactured and prior to shipping. Typical roof curbs are relatively large in size, and therefore, after being manufactured and prior to installation, take up a relatively large amount of space. For example, roof curbs may have a width of between two and four feet, a length of between four and eight feet, and a height of approximately twelve inches. In these dimensions, the number of roof curbs that can be shipped on a single pallet can be as low as seven. The large size of manufactured roof curbs results in relatively high costs associated with the storage and shipping of the roof curbs.

Thus, there is a need for an improved roof curb that reduces the costs associated with storage and shipping, while maintaining the curb's functionality and structural integrity when installed on a rooftop.

SUMMARY OF THE INVENTION

In one or more embodiments, a roof curb according to the concepts of the present invention may include an opening in a roof substrate; a roof curb positioned around the opening, the roof curb including; a base portion including opposed end walls and opposed side walls extending between the end walls; an upper portion including opposed upper end walls and opposed upper side walls; and a hinge connecting each of the end walls of the base portion to the end walls of the upper portion and the side walls of the base portion to the side walls of the upper portion, the hinges adapted to allow the end walls and side walls of the upper portion to pivot from a collapsed position to an extended position; and a roofing membrane positioned over the roof substrate and around the roof curb.

In one or more embodiments, a roof curb according to the concepts of the present invention may include a metal base portion including opposed end walls and opposed side walls extending between the end walls and welded to the end walls; and a metal upper portion including opposed upper end walls hingedly connected to the end walls of the base portion, and opposed upper side walls hingedly connected to the side walls of the base portion, each of the upper end walls and side walls being independently pivotable between a collapsed position and an extended position.

In one or more embodiments, a method of installing a roof curb according to the concepts of the present invention may include pivoting opposed upper end walls of a roof curb relative to a base portion from a collapsed position to an extended position; pivoting opposed upper side walls of the roof curb relative to a base portion from a collapsed position to an extended position; and positioning the roof curb in the desired position on a roofing surface and securing the base portion of the roof curb to the roofing surface.

DETAILED DESCRIPTION OF THE ILLUSTRATIVE EMBODIMENTS

Collapsible roof curbs made in accordance with the present disclosure include a base portion and hinged upper wall portions that fold relative to the base portion along a horizontally oriented hinge. In one or more embodiments, the base portion and the upper wall portions may be metal. The lower base portion may be welded to form a single integral unit or piece, and may include an outwardly extending mounting flange projecting from a lower edge that may be used to structurally mount the curb to the roof deck or substrate. The collapsible roof curbs can be stored and shipped in a collapsed position, and can then be easily expanded to full height by unfolding the upper wall portions so that they lock into position. In this way the effective size, or height, of the roof curbs is reduced during storage and shipment, thereby reducing the costs associated with storing and shipping the roof curbs. In certain embodiments, the number of roof curbs that can be stacked on a single pallet may be doubled as compared to conventional curbs by utilizing the roof curb of the present disclosure. In one or more embodiments, the number of roof curbs that can be stacked on a single pallet may be greater than double as compared to conventional curbs, depending on the orientation and dimensions of the collapsible or foldable sides.

Figure 1:
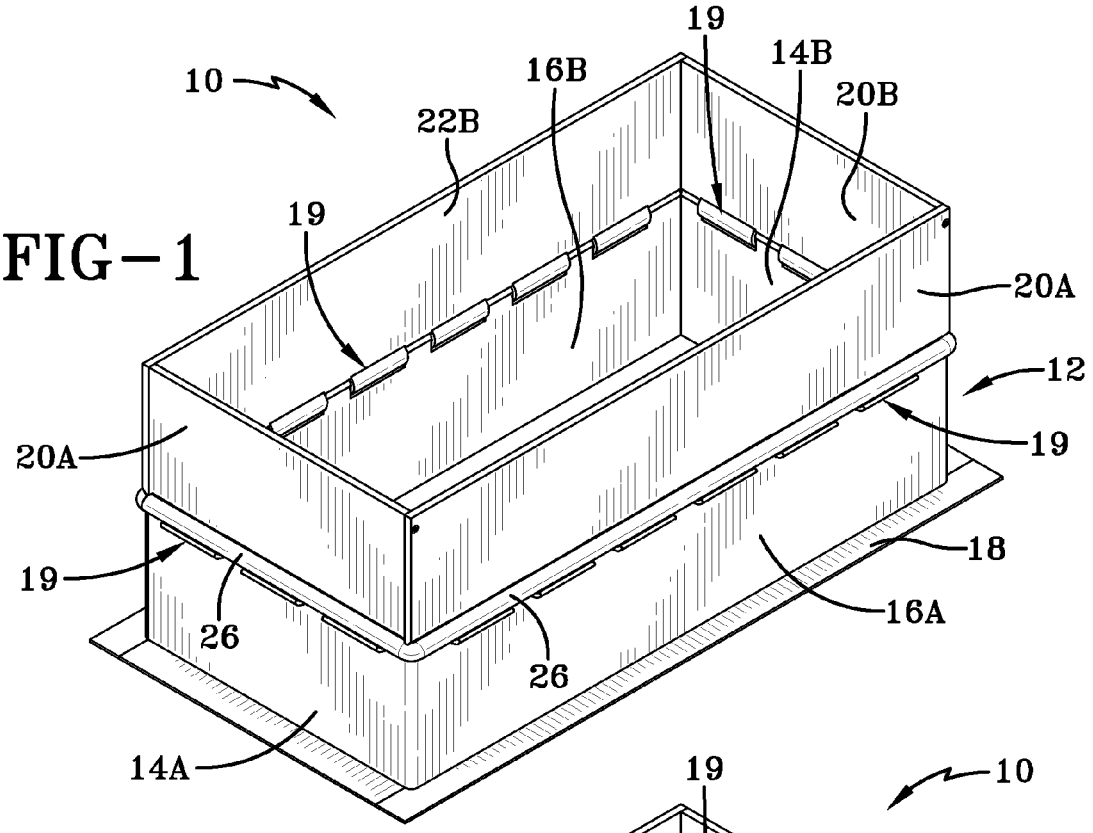
FIG. 1 is an isometric view of a collapsible roof curb in an extended position made according to one or more concepts of the present disclosure.
Figure 2:
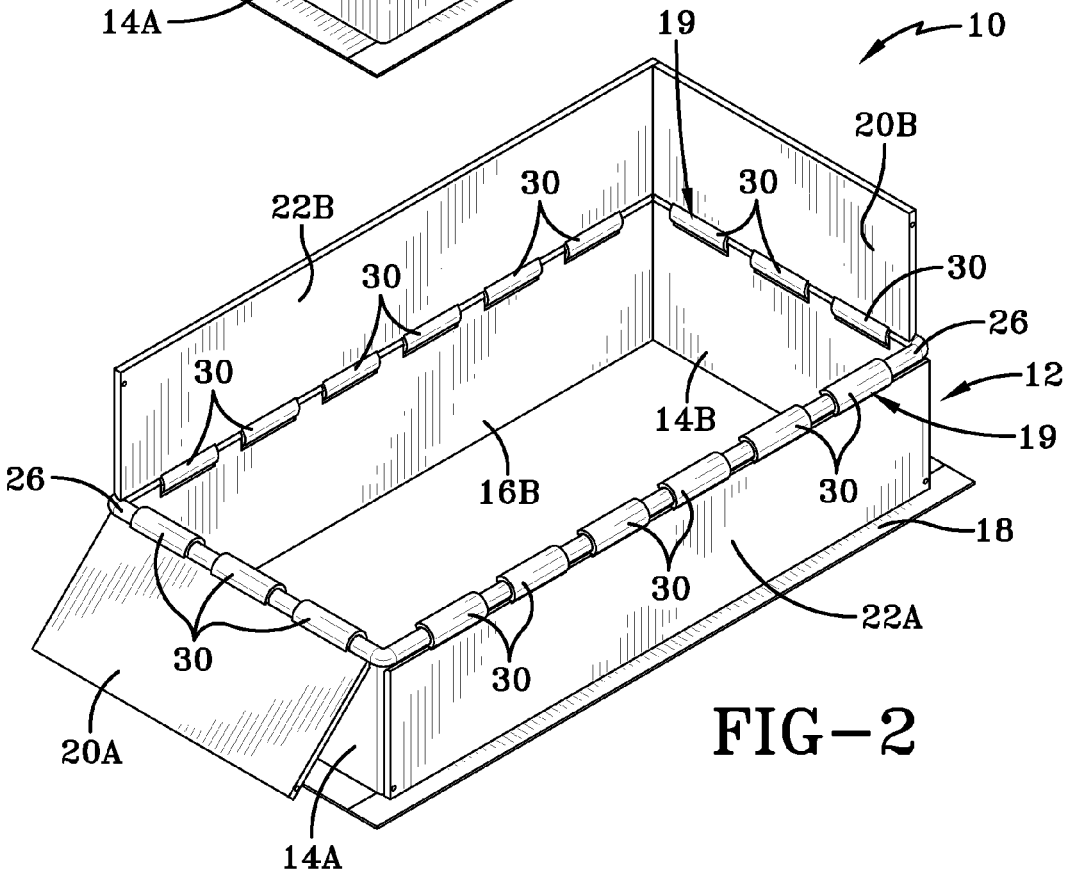
FIG. 2 is an isometric view of the collapsible roof curb of FIG. 1 in a partially collapsed position.
Figure 3:
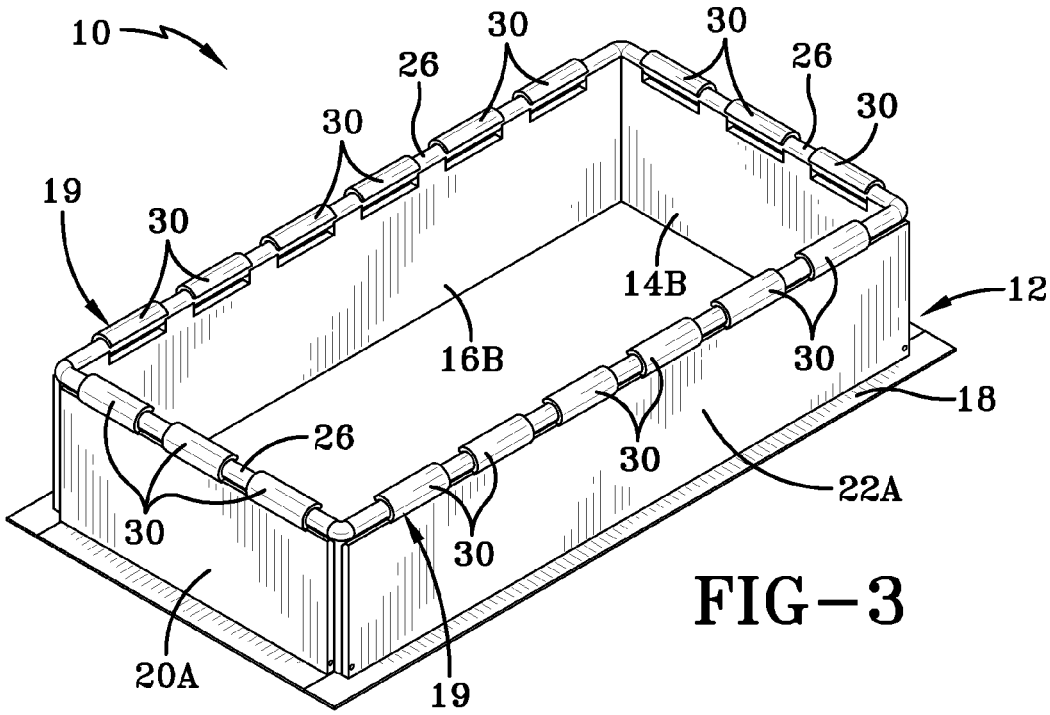
FIG. 3 is an isometric view of the collapsible roof curb of FIG. 1 in a fully collapsed position.

Referring now to FIGS. 1-3 a roof curb according to the concepts of the present disclosure is shown, and is indicated generally by the numeral 10. Roof curb 10 is adapted to be secured to a roofing surface around an opening that provides access to the interior of the building. In one or more embodiments, roof curb 10 may be a single wall metal roof curb having walls formed of a single layer of metal as shown in FIGS. 1-6. In other embodiments, roof curb 10 may be a double wall metal roof curb having walls formed by spaced metal layers with an inner volume therebetween. In certain embodiments, the inner volume of the double wall metal roof curb may be filled with an insulation layer that may be either pre-fabricated with the roof curb or inserted into the inner volume after installation of the curb on a roof surface.

In one or more embodiments, roof curb 10 may include a base portion 12 having opposed end walls 14*a* and 14*b* and opposed side walls 16*a* and 16*b* extending between end walls 14*a* and 14*b*. In certain embodiments, base portion 12 may be generally rectangular in shape, having end walls 14*a* and 14*b* of approximately equal lengths, and side walls 16*a* and 16*b* of approximately equal lengths, the end walls and side walls being oriented generally perpendicular to one another. In certain embodiments, base portion 12 may be generally square in shape, with the end walls and the side walls having approximately equal lengths. In one or more embodiments, end walls 14*a* and 14*b* may be welded to side walls 16*a* and 16*b* at the intersecting corners.

In one or more embodiments, end walls 14*a* and 14*b* may have a length of between approximately 2 and 5 ft. In the same or other embodiments, side walls 16*a* and 16*b* may have a length of between approximately 4 and 8 ft. In certain embodiments, end walls 14*a* and 14*b* and side walls 16*a* and 16*b* may have a height of between approximately 5 and 12 inches.

In one or more embodiments, base portion 12 may include an outwardly extending flange 18 extending from a bottom edge of end walls 14*a* and 14*b* and side walls 16*a* and 16*b*. In certain embodiments, flange 18 may be welded to the lower edges of the end walls and side walls. Flange 18 is adapted to facilitate attachment of roof curb 10 to a roofdeck or substrate. In one or more embodiments, a plurality of fasteners may be driven through flange 18 and into the roof deck or substrate to secure roof curb 10 in position.

In one or more embodiments, each end wall 14*a* and 14*b*, and each side wall 16*a* and 16*b* is attached to an upper wall portion 20*a*, 20*b*, 22*a* and 22*b*, respectively, by one or more hinges 19. Thus, upper end wall portion 20*a* is hingedly attached to end wall 14*a*, upper end wall portion 20*b* is hingedly attached to end wall 14*b*, upper side wall portion 22*a* is hingedly attached to side wall 16*a*, and upper side wall portion 22*b* is hingedly attached to side wall 16*b*. Upper wall portions 20*a*, 20*b*, 22*a* and 22*b* may be hingedly attached to base portion 12 by any method or mechanism known to those skilled in the art. In one or more embodiments, the upper wall portions may each include a nailer and a receiving flange at a top edge, opposite the one or more hinges 19, to facilitate attachment of a roofing waterproofing layer and rooftop unit and to provide rigidity to the roof curb 10.

In one or more embodiments, upper wall portions 20*a*, 20*b*, 22*a*, and 22*b* may have a height approximately equal to the height of the end wall 14*a* or 14*b* or side wall 16*a* or 16*b* to which they are attached. In other embodiments, the upper wall portions may have a height that is less than the height of the end wall or side wall to which they are attached. In certain embodiments, upper wall portions 20*a*, 20*b*, 22*a* and 22*b* may have a height of between approximately 5 and 12 inches. In a particular embodiment, the end walls and side walls of the base portion 12 and the upper wall portions 20*a*, 20*b*, 22*a*, and 22*b* each may have a height of approximately 6 inches.

In one or more embodiments, and as shown in FIGS. 1-3, upper wall portions 20*a*, 20*b*, 22*a* and 22*b* may all fold outward so that, in a collapsed position, each of the upper wall portions is positioned to the exterior of the base portion 12. In other embodiments, upper end wall portions 20*a* and 20*b* may be adapted to fold inward so that, in a collapsed position, the upper end wall portions are positioned within base portion 12, and upper side wall portions 22*a* and 22*b* may be adapted to fold outward so that, in a collapsed position, the upper side wall portions are positioned to the exterior of base portion 12. It is also contemplated that the folding of the upper end walls and upper side walls may be reversed so that, in a collapsed position, upper end wall portions 20*a* and 20*b* are positioned to the exterior of base portion 12, and the upper side wall portions 22*a* and 22*b* are positioned to the interior of base portion 12. As used herein, the terms interior and exterior refer to the inner area defined by base portion 12, with the interior being within the inner area, and the exterior being outside the inner area.

Figure 4:
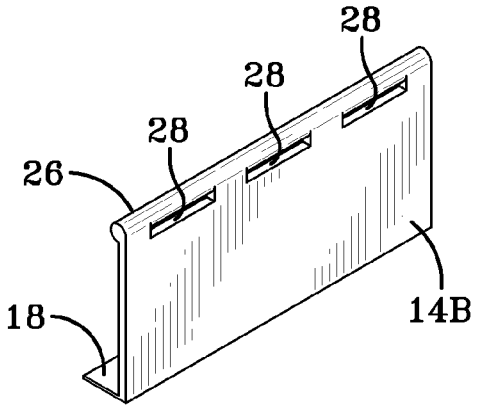
FIG. 4 is a perspective view of an end wall of the roof curb of FIG. 1.
Figure 5:
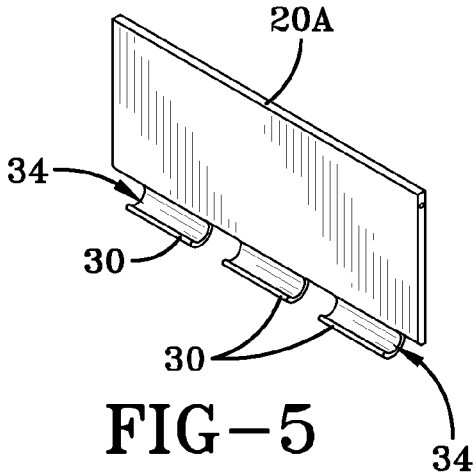
FIG. 5 is a perspective view of an upper wall of the roof curb of FIG. 1.
Figures 6A, 6B, 6C, 6D:
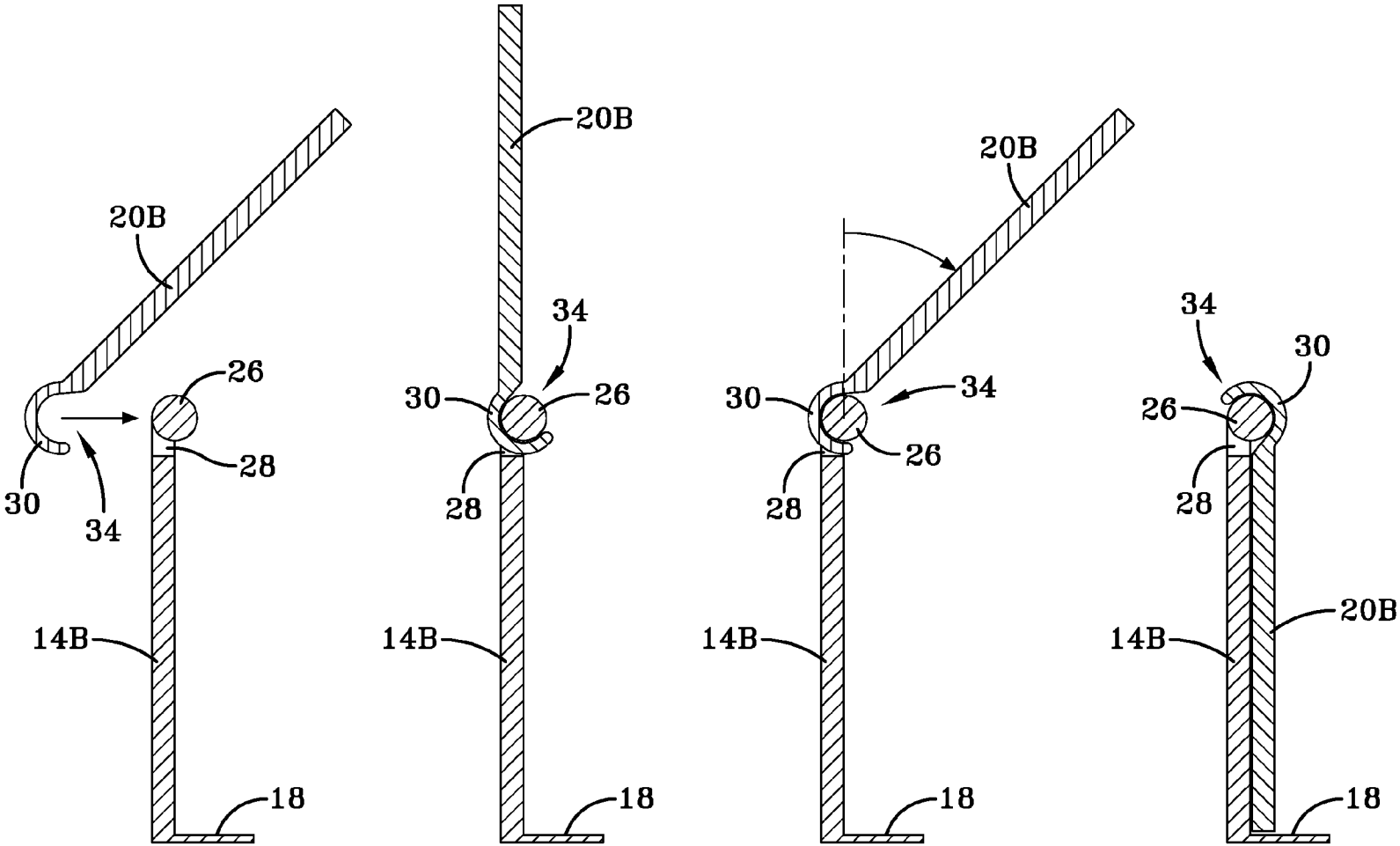
FIGS. 6A-6D are sectional views showing the folding motion of the collapsible roof curb of FIG. 1.

Referring now to FIGS. 4 and 5, an exemplary hinge 19 will be described. In one or more embodiments, the hinges 19 between base portion 12 and upper wall portions 20*a*, 20*b*, 22*a*, and 22*b* may include a pin portion 26 formed by an enlarged portion of each of the end walls 14*a* and 14*b* and side walls 16*a* and 16*b*. In certain embodiments, pin portion 26 may have a larger cross sectional width than the walls of base portion 12. Stated differently, the diameter of the pin portion 26 may be greater than the thickness of the walls of the base portion 12. In one or more embodiments, pin portion 26 may have a generally circular profile, and may define an axis of rotation for the hinge 19. A plurality of spaced slots 28 (FIG. 4) may be provided along the length of the walls of base portion 12 adjacent to pin portion 26.

In one or more embodiments, upper wall portions 20*a*, 20*b*, 22*a*, and 22*b* may include arcuate hinge portions 30 spaced along a bottom edge thereof, the hinge portions 30 being adapted to fit over pin portion 26 and to be received in spaced slots 28. In certain embodiments, hinge portions 30 may include an axially extending opening 32 (FIG. 5) adapted to facilitate assembly of hinge 19 by allowing hinge portion 30 to deform slightly to fit over and around pin portion 26. As will be appreciated by those skilled in the art, arcuate hinge portions 30, pin portions 26, and slots 28 allow upper wall portions 20*a*, 20*b*, 22*a*, and 22*b* to pivot relative to end walls 14*a* and 14*b* and side walls 16*a* and 16*b*.

In one or more embodiments, roof curb 10 may include a locking mechanism 34 to maintain upper wall portions 20*a*, 20*b*, 22*a*, and 22*b* in the extended, or un-collapsed, position after they have been pivoted from the collapsed position. Locking mechanism 34 may be any suitable mechanism known to those skilled in the art and capable of performing the intended function. For example, in one or more embodiments, the locking mechanism may include a locking pin extending between the base portion 12 and the upper wall portions, and in other embodiments, the locking mechanism may include a pawl that prevents rotation of the upper wall portion back to the collapsed position. It is also contemplated that locking mechanisms may be provided at the corner intersections of the upper wall portions 20*a*, 22*a*, 20*b*, and 22*b* to prevent rotation of the upper wall portions back to the collapsed position. As shown in FIGS. 1-3, locking mechanism 34 may be a screw provided at each corner of the upper wall portions to secure the upper end walls 20*a* and 20*b* to the upper side walls 22*a* and 22*b*. In one or more embodiments, the locking mechanism may be releasable by the use of a release mechanism such that the walls can be re-folded or re-collapsed into its original position.

In an alternative embodiment, where roof curb 10 is of double wall construction, it is contemplated that two hinges may be provided along each end wall and each side wall, a first hinge on an inner wall of the roof curb, and a second hinge on an outer wall of the roof curb. In certain embodiments, the upper portion of the inner wall may pivot inward, and the upper portion of the outer wall may pivot outward. In certain embodiments, an inner support platform may be provided at the base of the double walled cavity of the welded base portion of the roof curb to join the two walls. In one or more embodiments, an insulation layer may be inserted between the inner and outer walls after they have been pivoted to an extended position at the installation site, and the insulation layer may be supported and retained by the support platform at the base of the double walled cavity.

In practice, the roof curb 10 of the present invention may be stored and shipped in a collapsed position so that it takes up less space. During installation of the roof curb, the upper wall portions may be rotated into an extended position to provide the required height. In certain embodiments, where a double wall roof curb is provided, an insulation layer may be positioned and supported in place between the inner and outer layers of the upper wall portions during installation. The roofing system being installed may then be secured to an upper edge of the upper wall portions, thereby further securing them against additional pivoting about the hinge axis. As is known to those skilled in the art, curb waterproofing flashing materials may then be secured up and over the roof curb 10 to seal the curb against water infiltration. The curb flashing may be any suitable flashing known to those skilled in the art.

Various modifications and alterations that do not depart from the scope and spirit of this invention will become apparent to those skilled in the art. This invention is not to be unduly limited to the illustrative embodiments set forth herein.

What is claimed is:

1. A roof system comprising:

a roof substrate having an opening therethrough;

a roof curb positioned around the opening, the roof curb including;

base portion including opposed end walls and opposed side walls extending between the end walls;

an upper portion including opposed upper end walls and opposed upper side walls; and a hinge connecting each of the end walls of the base portion to the end walls of the upper portion and the side walls of the base portion to the side walls of the upper portion, the hinges adapted to allow the end walls and side walls of the upper portion to pivot from a collapsed position to an extended position wherein said opening is maintained in said collapsed position; and a roofing membrane positioned over the roof substrate and around the roof curb.

2. The roof curb of claim 1, wherein the base portion of said roof curb includes an outwardly extending flange protecting from a lower edge of each of the end walls and side walls for securing said roof curb to the roof substrate.

* * * * *